US005987658A

United States Patent [19]

Richards et al.

[11] Patent Number: 5,987,658

[45] Date of Patent: Nov. 23, 1999

[54] SINGLE MOTOR, DUAL CLUTCH MARINE VESSEL TOILET

[75] Inventors: William G. Richards, Portsmouth, R.I.; Donald T. Allen, Madison, Conn.; David Sauro, South Kingstown, R.I.; Richard E. Baierlein, Longboat Key, Fla.

[73] Assignee: Wilcox Crittenden, Inc., Waterford, Conn.

[21] Appl. No.: 09/163,486

[22] Filed: Sep. 30, 1998

[51] Int. Cl.[6] ..... E03D 9/10

[52] U.S. Cl. ..... 4/300; 4/319; 4/433

[58] Field of Search ..... 4/300, 319–323, 4/313, 431–433; 416/124, 128, 169 R, 172; 137/596.17, 597

[56] References Cited

U.S. PATENT DOCUMENTS

| | | | |
|---|---|---|---|
| 689,914 | 12/1901 | Sands et al. . | |
| 689,915 | 12/1901 | Sands . | |
| 1,329,932 | 2/1920 | Sell et al. . | |
| 1,625,950 | 4/1927 | Lee . | |
| 1,732,192 | 10/1929 | Lee . | |
| 1,822,319 | 9/1931 | Schwarz . | |
| 1,888,842 | 11/1932 | Allan . | |
| 3,035,274 | 5/1962 | Baughman . | |
| 3,275,550 | 9/1966 | Daubenspeck | 4/319 |
| 3,478,690 | 11/1969 | Helke et al. . | |
| 3,593,346 | 7/1971 | Katona . | |
| 3,699,592 | 10/1972 | Minchak | 4/320 |
| 3,727,241 | 4/1973 | Drouhard, Jr. et al. | 4/319 |
| 3,846,847 | 11/1974 | Tufts et al. | 4/320 |
| 3,878,569 | 4/1975 | Peirish, Jr. et al. | 4/319 |
| 4,131,959 | 1/1979 | Albertassi et al. . | |
| 4,246,665 | 1/1981 | Albertassi et al. . | |
| 4,974,264 | 12/1990 | Brian . | |

FOREIGN PATENT DOCUMENTS

| | | |
|---|---|---|
| 266948 | 3/1927 | United Kingdom . |

*Primary Examiner*—Charles R. Eloshway
*Attorney, Agent, or Firm*—Salter & Michaelson

[57] ABSTRACT

A fluid circulation system is disclosed, comprising a bidirectional motor, a first housing having a fluid inlet and a fluid outlet, a second housing having a fluid inlet and a fluid outlet, a fluid holding device coupled between the fluid outlet of the first housing and the fluid inlet of the second housing, a drive shaft operatively coupled to the motor to be driven by the motor, the drive shaft extending from the motor into the first and second housings and a first fluid transfer device mounted on the drive shaft within the first housing. The first fluid transfer device is operative to transfer fluid from the fluid inlet of the first housing, through the fluid outlet of the first housing and into the fluid holding device when the motor drives the drive shaft in a first direction. The system further includes a second fluid transfer device mounted on the drive shaft within the second housing, the second fluid transfer device being operative to transfer water from the fluid holding device, through the fluid inlet of the second housing and through the fluid outlet of the second housing when the motor drives the drive shaft in a second direction, the second direction being opposite the first direction.

17 Claims, 7 Drawing Sheets

SINGLE MOTOR, DUAL CLUTCH MARINE VESSEL TOILET

BACKGROUND OF THE INVENTION

1. Field of the Invention

The present invention generally relates to a marine toilet system, and more particularly to a marine toilet system having a single bidirectional motor which drives a drive shaft, a first impeller mounted on the drive shaft for filling a toilet bowl with fluid and a second impeller mounted on the drive shaft for emptying fluid from the toilet bowl.

2. Discussion of the Related Art

Marine vessel toilet systems have several operational requirements which are different from household toilet systems. One difference is that the bowl of the marine vessel toilet system is generally dry when the toilet is not in use, since the motion of the marine vessel could cause any water in the bowl to splash out of the bowl. It is also desirable to minimize the amount of water used to fill the bowl when it is used. This is because the toilet bowl is often evacuated to a holding tank for later disposal. Therefore, it is important to keep the amount of water held in the holding tank to a minimum. Furthermore, in some cases, the water input to the toilet bowl is drawn from the marine vessel's fresh water supply, in order to minimize any odors. Due to the finite amount of fresh water which can be stored on a vessel, it is important to minimize the amount of water used to operate the toilet system.

There are several different prior art designs of toilets for use on marine vessels. One design include toilets which use one pump for pumping water into the bowl of the toilet and a second pump for pumping water and waste from the bowl. Since this design requires two pumps, the toilet system is very heavy, expensive and more prone to malfunctioning.

Other designs use a single pump to both pump water into the bowl and to pump it from the bowl. However, these toilets require the use of a number of valves which are manually set to control whether the filling or emptying operation is carried out while the motor is running. Some examples of this design are disclosed in U.S. Pat. Nos. 1,329,932 and 1,888,842. U.S. Pat. No. 3,035,274 discloses a toilet system which uses a single pump to fill and flush the toilet simultaneously. U.S. Pat. No. 3,478,690 discloses a toilet system which utilizes a bidirectional pump which rotates a shaft in opposite directions in order to break up solid waste in the water while directing the flow of the water in one direction only. U.S. Pat. No. 4,974,264 discloses a toilet system which utilizes a vacuum device for filling and flushing the toilet. This system also requires the use of a number of manual valves for controlling which function is to be carried out.

While these designs are effective in filling and flushing toilets, they can cumbersome to operate, can be very heavy and very inefficient, can take up a large amount of deck space on a marine vessel, are more prone to requiring maintenance and can be very expensive.

There is therefore a need for a marine toilet system which is simple to use, occupies less deck space, operates efficiently, is less expensive to manufacture and is less prone to requiring maintenance.

SUMMARY OF THE INVENTION

The present invention provides a marine vessel toilet system which utilizes a single motor to drive a single drive shaft. When the motor drives the drive shaft in a first direction, a first impeller mounted on the drive shaft transfers water into a bowl of the toilet system. When the motor drives the drive shaft in a second direction, a second impeller mounted on the drive shaft transfers water and waste from the bowl of the toilet system, thereby flushing the bowl. The first and second impellers are mounted on the drive shaft via roller clutches. Therefore, when the drive shaft is driven in the first direction, the second impeller is disengaged from the drive shaft and does not rotate, and when the drive shaft is driven in the second direction, the first impeller is disengaged from the drive shaft and does not rotate. The direction of the motor is controlled by a foot switch operated by the user of the toilet system. The foot switch enables the user to control the exact amount of water used to fill the bowl and the exact amount of water required to flush the bowl.

According to a first embodiment of the invention, a fluid circulation system is disclosed, comprising a bidirectional motor, a first housing having a fluid inlet and a fluid outlet, a second housing having a fluid inlet and a fluid outlet, a fluid holding device coupled between the fluid outlet of the first housing and the fluid inlet of the second housing, a drive shaft operatively coupled to the motor to be driven by the motor, the drive shaft extending from the motor into the first and second housings, a first fluid transfer device mounted on the drive shaft within the first housing, the first fluid transfer device being operative to transfer fluid from the fluid inlet of the first housing, through the fluid outlet of the first housing and into the fluid holding device when the motor drives the drive shaft in a first direction and a second fluid transfer device mounted on the drive shaft within the second housing, the second fluid transfer device being operative to transfer water from the fluid holding device, through the fluid inlet of the second housing and through the fluid outlet of the second housing when the motor drives the drive shaft in a second direction, the second direction being opposite the first direction.

According to another embodiment of the invention, a toilet system is disclosed, comprising a bidirectional motor for driving a drive shaft in first and second directions, a housing having a first fluid inlet, a first fluid outlet and a first interior cavity disposed between the first inlet and the first outlet, a first impeller for transferring fluid from the first fluid inlet to the first fluid outlet, the first impeller being supported on the drive shaft within the first interior cavity, wherein, when the motor drives the drive shaft in the first direction, the first impeller engages the drive shaft, rotates in the first direction and transfers fluid from the first fluid inlet to the first fluid outlet, and when the motor drives the drive shaft in the second direction, the first impeller disengages from the drive shaft, and thereby is idle, a base unit having a second fluid inlet, a second fluid outlet and a second interior cavity disposed between the second fluid inlet and the second fluid outlet, a second impeller for transferring fluid from the second fluid inlet to the second fluid outlet, the second impeller being supported on the drive shaft within the second interior cavity, wherein, when the motor drives the drive shaft in the second direction, the second impeller engages the drive shaft, rotates in the second direction and transfers fluid from the second fluid inlet to the second fluid outlet, and when the motor drives the drive shaft in the first direction, the second impeller disengages from the drive shaft, and thereby is idle, a toilet bowl having a third fluid inlet and a third fluid outlet, the third fluid inlet being in fluid communication with the first fluid outlet of the housing and the third fluid outlet being in fluid communication with the second fluid inlet and a switch for determining which of the first and second directions the bidirectional motor drives the drive shaft.

Other features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

Figure 1:
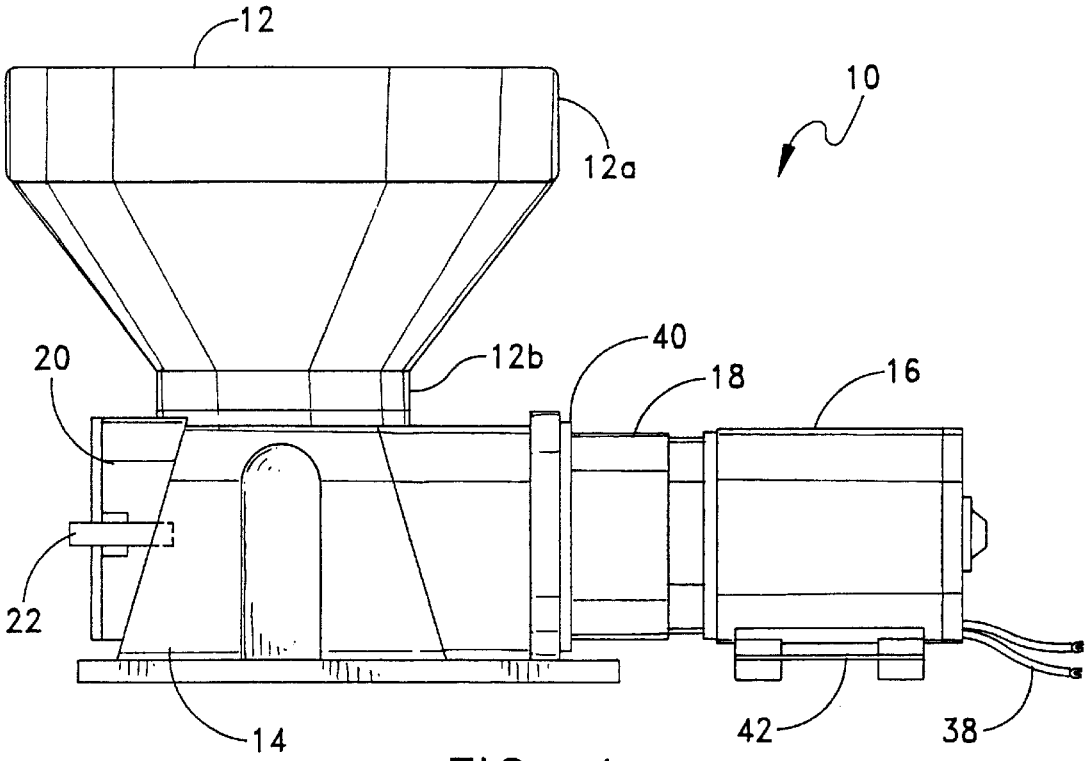
FIG. 1 is a side view of the toilet system of the present invention.
Figure 2:
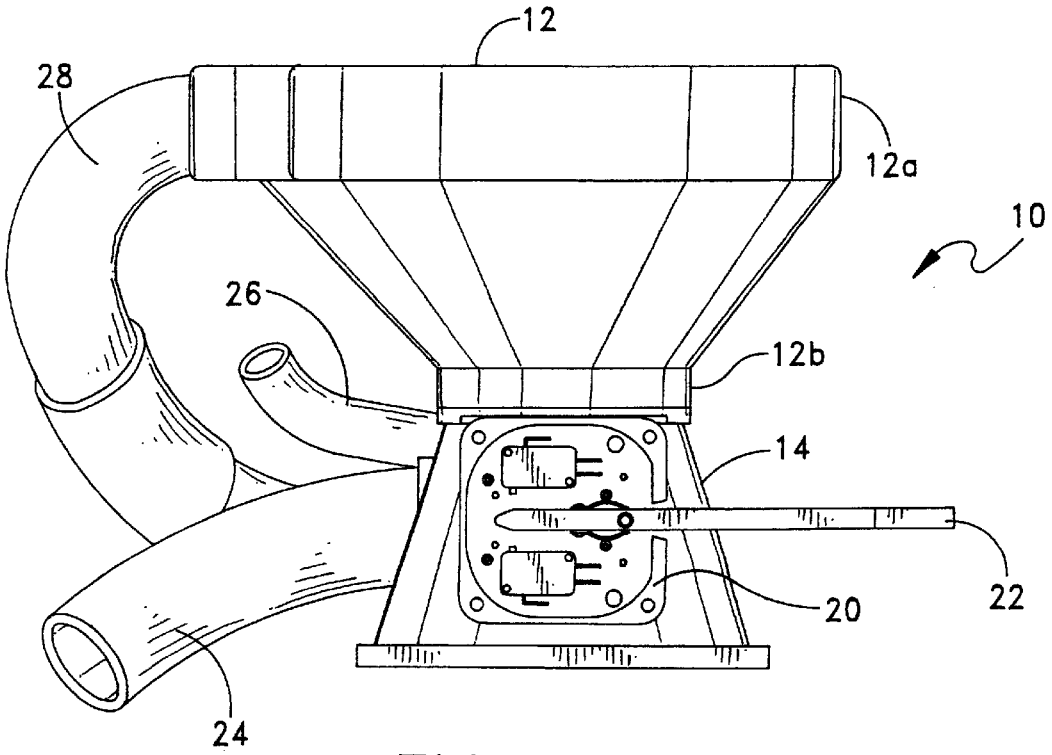
FIG. 2 is a front view of the toilet system of the present invention.
Figure 3:
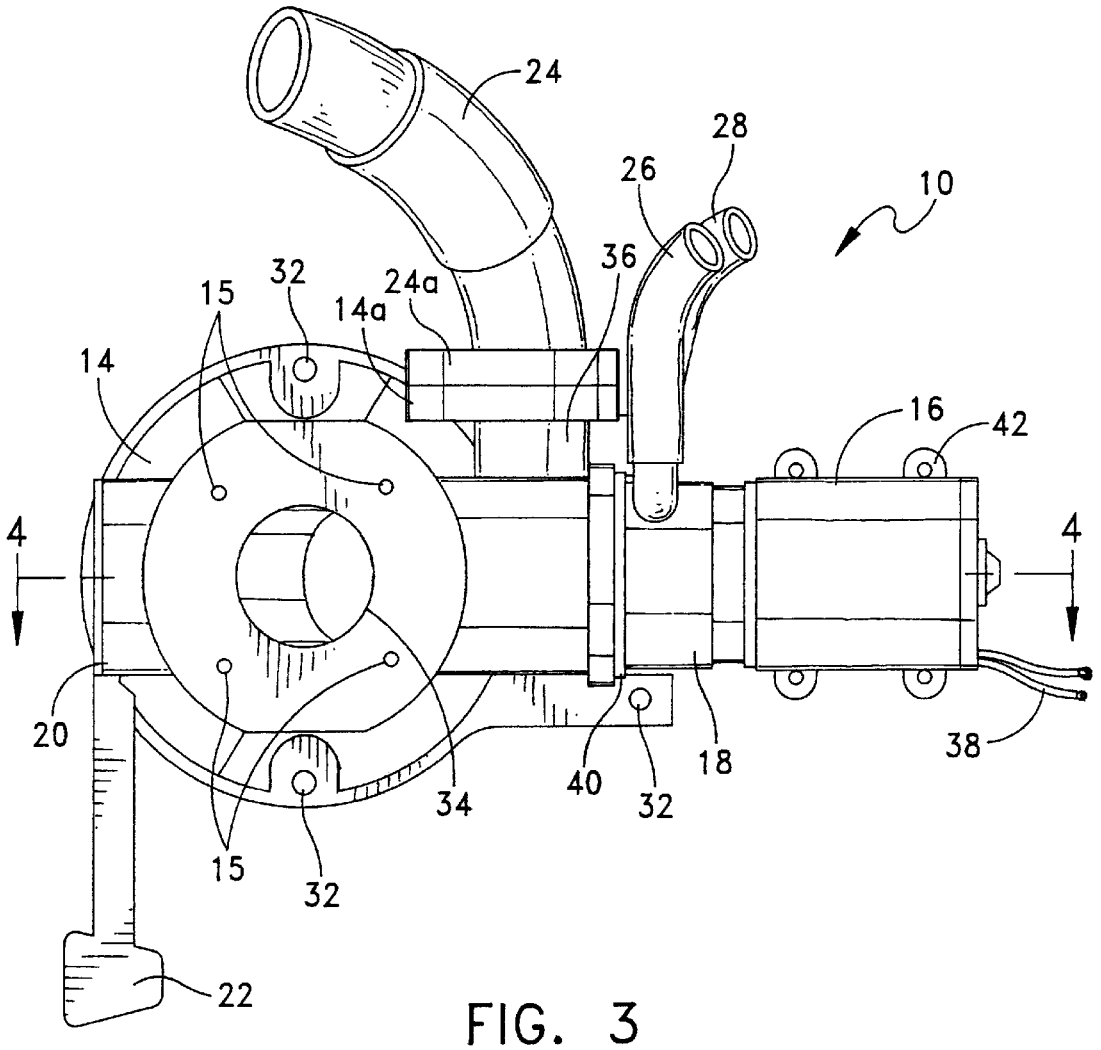
FIG. 3 is a top view of the toilet system of the present invention, with the bowl removed.

Referring now to the drawings, and more particularly FIGS. 1–3, there is generally indicated at 10 a marine vessel toilet system of the present invention. FIG. 1 is a side view of the toilet system 10, FIG. 2 is a front view of the system 10 and FIG. 3 is a top view of the system 12, with the toilet bowl 12 removed. Marine vessel toilet system 10 includes a toilet bowl 12, having a rim portion 12*a* and a mounting plate 12*b*. Mounting plate 12*b* of toilet bowl 12 is mounted to a base unit 14 via mounting holes 15 in base unit 14. Base unit 14 is mounted to a deck of a marine vessel via mounting holes 32. Base unit 14 includes a base unit inlet port 34 and a base unit outlet port 36. A waste water outlet pipe 24 has a mounting plate 24*a* at one end which is mounted to a mounting plate 14*a* of base unit 14. The other end of waste water outlet pipe 24 is coupled to a holding tank or to an output port of the of the vessel (not shown) for evacuating waste from the toilet system 10. A switch unit 20, including a foot pedal 22 is also mounted to base unit 14. Switch unit 20 will be described in greater detail below.

Figure 4:
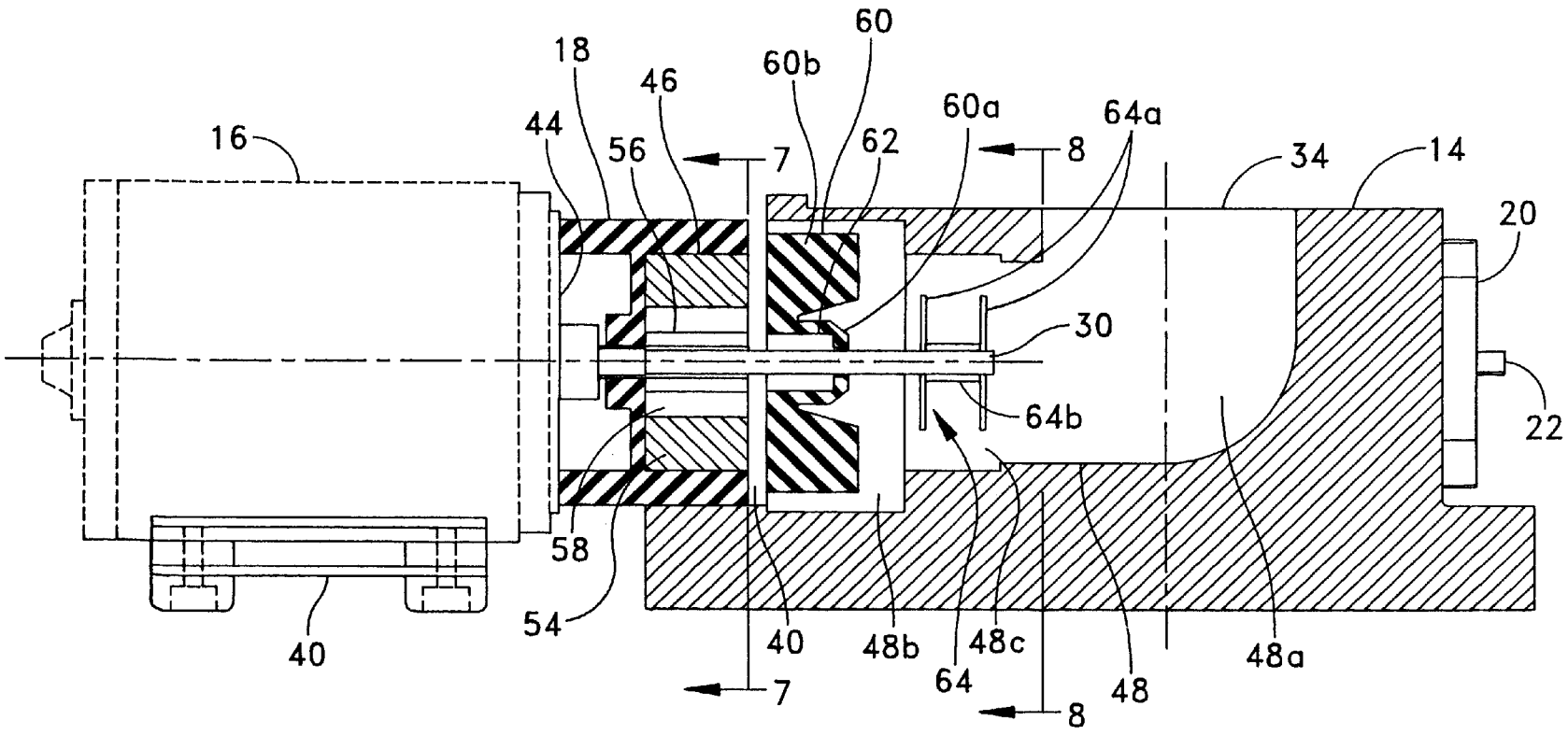
FIG. 4 is a cross sectional view of the toilet system, taken along line 4—4 of FIG. 3.
Figure 5:
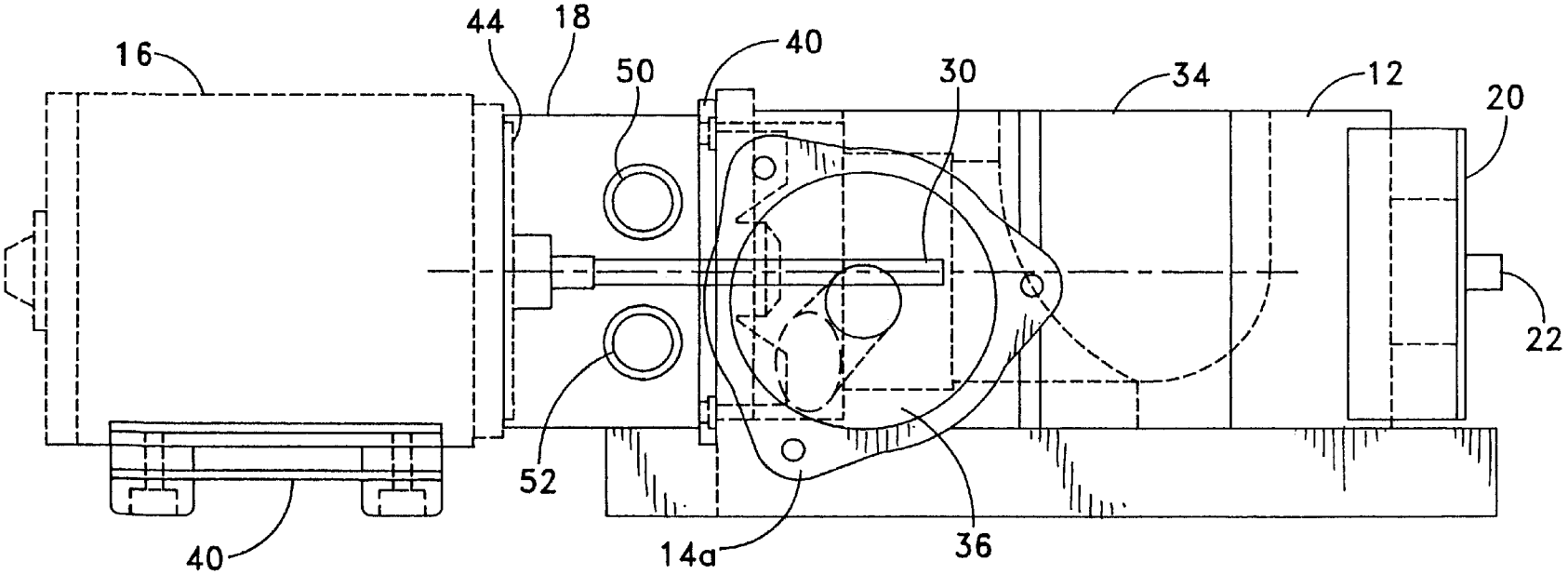
FIG. 5 is a partial cross-sectional view of the toilet system, taken along line 4—4 of FIG. 3.
Figure 6:
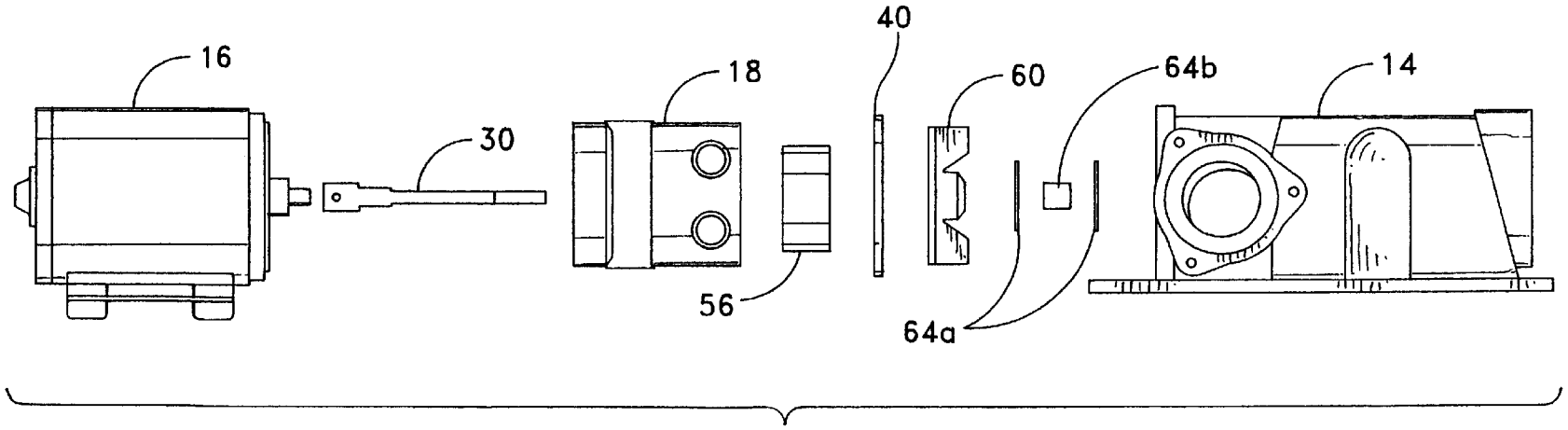
FIG. 6 is an exploded view of the toilet system shown in FIG. 4.

Toilet system 10 further includes a bidirectional motor 16 for driving a drive shaft 30, shown in FIGS. 4 and 5. FIG. 4 is a cross-sectional diagram of the system 10 taken along line 4—4 of FIG. 3 and FIG. 5 is a partial cross-sectional diagram of the system 10. In FIGS. 4 and 5, toilet bowl 12 is not shown for simplicity. Bidirectional motor 16 is connected to a power source via power leads 38. Any type of a bidirectional motor may be used as motor 16, for example, motors powered by alternating current, direct current and air power. Bidirectional motor 16 is mounted to the deck of the vessel via mounting bracket 42. Bidirectional motor 16 is coupled to an input housing 18, having an interior portion which defines a fluid input chamber 46. Input housing 18 includes a fluid input port 50, for receiving fresh water from a fresh water source (not shown) through a fresh water inlet pipe 26. While the water input into the toilet system is referred to as fresh water, this is to contrast the water with the waste water which is evacuated from the toilet system. Therefore, the fresh water referred to in this application may be fresh water from the vessel's supply tank, or fresh or salt water drawn in from outside the vessel. Housing 18 also includes a fresh water output port 52 for outputting fresh water from input chamber 46 to rim 12*a* of bowl 12 through a fresh water transfer pipe 28. Fresh water transfer pipe 28 is connected at one end to fresh water outlet port 52 of input housing 18 at another end thereof to rim 12*a* of bowl 12 in a conventional manner known in the art.

Input housing 18 is coupled to base unit 12 through an adapter plate 40, which sealingly isolates fluid input chamber 46 from fluid output chamber 48 using a series of o-rings and gaskets in a conventional manner which allows drive shaft 30 to pass from input chamber 46 into output chamber 48. Interior chamber 46 also includes a shaft seal 44 which sealingly isolates interior chamber 46 from motor 16.

Output chamber 48 includes a fluid holding portion 48*a*, a fluid discharge portion 48*b* and a chopping portion 48*c*.

Figure 7:
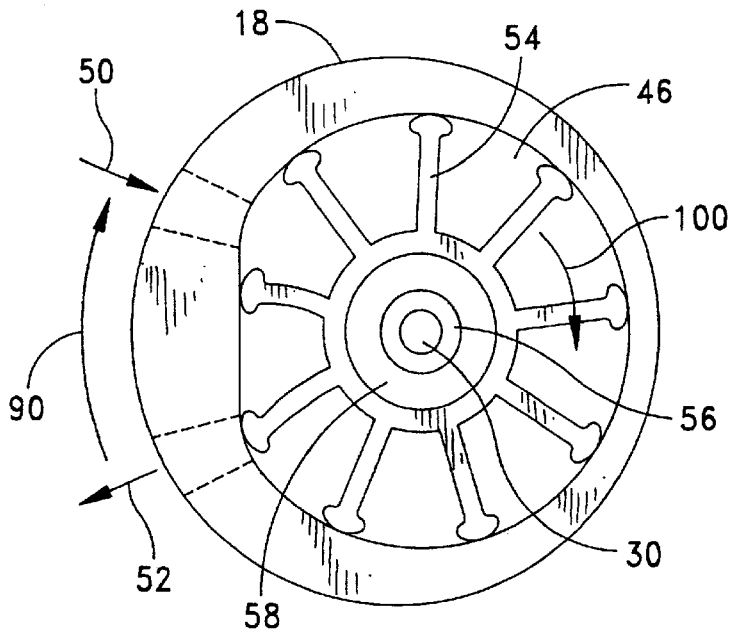
FIG. 7 is a cross-sectional view of the toilet system showing the rubber impeller of the present invention, taken along line 7—7 of FIG. 4.

Drive shaft 30 is connected to motor 16 in a conventional manner, such as with set screws. As shown in FIGS. 4 and 5, drive shaft 30 is formed of such a length that it extends from motor 16 through input chamber 46 and into output chamber 48. A rubber impeller 54, FIG. 4, is mounted on drive shaft 30 within input chamber 46. As is described in greater detail below with reference to FIG. 7, rubber impeller 54 draws fresh water from fresh water inlet pipe 26 and fresh water input port 50 into input chamber 46 and then drives the fresh water from input chamber 46 to the rim 12*a* of bowl 12 through fresh water outlet port 52 and fresh water transfer pipe 28.

In the preferred embodiment, the rubber impeller 54 is fitted with a stainless steel insert 58 at its center portion. The stainless steel insert may be permanently attached to the rubber impeller 54 through a press fit, adhesive, vulcanizing or other suitable means. The rubber impeller 54 and stainless steel insert 58 are then mounted on drive shaft 30 through a roller clutch bearing 56 which is press fit into the stainless steel insert 58. Alternatively, the stainless steel insert 58 and the roller clutch bearing 56 may be formed as a single unit which is attached to the rubber impeller 54. In the preferred embodiment, the roller clutch bearing 58 is formed from spring-loaded needle bearings which are fitted in a roller cage, which in turn is mounted within a housing. The roller clutch bearing is mounted on the drive shaft 30 such that, when the drive shaft 30 is rotated in a first direction, the springs fully extend within the roller cage and the bearings wedge between the roller cage and the drive shaft 30, causing the roller clutch bearing to lock on to the drive shaft, thereby causing the impeller to rotate in the first direction. When the drive shaft is rotated in the opposite direction, the springs compress, allowing the shaft to rotate within the bearing, without causing the impeller to rotate. Accordingly, depending on the orientation of the roller clutch bearing 56 on the drive shaft 30 and the direction of rotation of the drive shaft 30, the roller bearing is either engaged with the shaft, causing the impeller 54 to rotate, or the roller clutch bearing 56 is disengaged from the drive shaft 30, and the impeller does not rotate. This type of roller bearing is known in the art and is commonly available through, for example, Stockdrive Products of Hyde Park, N.Y. While this type of roller clutch bearing is preferred in the present invention, it will be understood that any bearing which allows the impeller to rotate when the drive shaft is turned in one direction and which allows the impeller to remain still while the drive shaft is rotated in the opposite direction may be used in the present invention.

An impeller 60 is mounted on drive shaft 30 within fluid discharge portion 48*b* of output chamber 48. Impeller 60 has a number of vanes 60*b* which lie in respective planes which project radially outwardly and parallel to a longitudinal axis of a central hub 60*a* of the impeller 60. Impeller 60 is preferably formed from brass and has a roller clutch bearing 62 press fit into the central hub 60*a*. Roller clutch bearing 62 is identical to roller clutch bearing 56, but is oriented to operate in an opposite fashion than roller clutch bearing 56. Specifically, when drive shaft 30 is rotated in a first direction such that roller clutch bearing 56 engages drive shaft 30, causing impeller 54 to rotate, roller clutch bearing 62 is disengaged from drive shaft 30 and impeller 60 does not rotate. Conversely, when drive shaft 30 is rotated in a second direction opposite the first direction, roller clutch bearing 56 is disengaged from drive shaft 30 and impeller 54 does not rotate, while roller clutch bearing 62 engages drive shaft 30, causing impeller 60 to rotate.

A chopping mechanism 64 is mounted on drive shaft 30 within chopping portion 48*c* of output chamber 48. In the preferred embodiment, chopping mechanism 64 is formed from a number of stainless steel blades 64*a* attached to a hub 64*b*, each of the blades 64*a* lying in plane which is perpendicular to a respective plane which projects radially outwardly from a longitudinal axis of the hub 64*b*. Alternatively, chopping mechanism 64 may be formed from any formation and orientation of blades or studs which can operate to macerate or break down any solid matter being discharged from the output chamber, as is described in greater detail below. Chopping mechanism 64 is fixed to drive shaft 30, and therefore rotates regardless of the rotating direction of drive shaft 30. However, due to the design of chopping mechanism 64, it cannot move water so it does not affect the filling and evacuating operations carried out by the impeller 56 and impeller 60, respectively.

Figure 8:
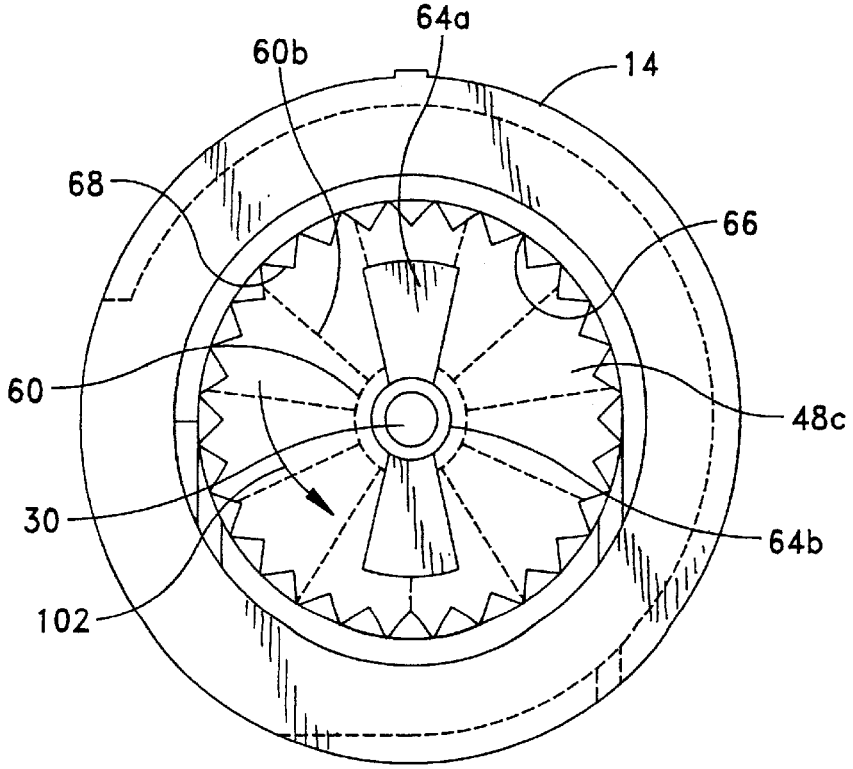
FIG. 8 a cross-sectional view of the toilet system showing the chopping portion of the present invention, taken along line 8—8 of FIG. 4.

Shown in FIG. 8, which is a cross-sectional diagram of the output chamber 48 of base unit 14 taken along line 8—8 of FIG. 4, the inner surface of the outer periphery of chopping portion 48*c* has a longitudinally ribbed structure 68 for increasing the effectiveness of chopping mechanism 64 in macerating the solid matter. Ribbed structure 68 may be integrally formed within base unit 14 or, preferably, it may be formed as a separate sleeve which is press fit into the base unit 14 and held in place using a conventional key and keyway method. Also shown in FIG. 8 is impeller 60, which is located behind chopping mechanism 64 and is shown in phantom.

Figure 9A:
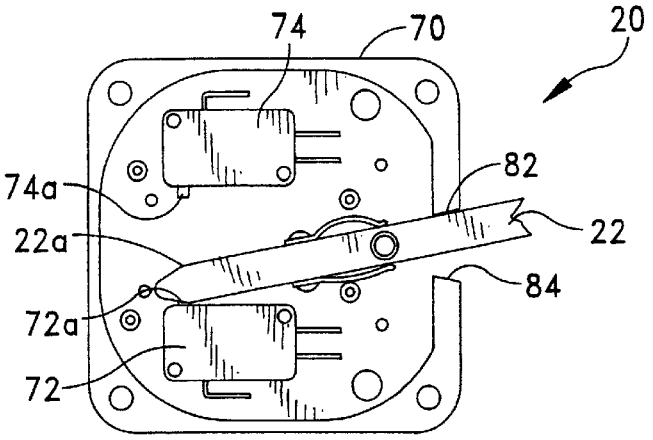
FIGS. 9, 9A and 9B show the operation of the switch mechanism of the present invention.

Switching mechanism 20 will now be described with reference to FIGS. 9, 9A and 9B. As shown in these figures, switch mechanism 20 includes a housing 70, which is mounted to base unit 14 as shown in FIGS. 1 and 2. Foot pedal 22 is pivotally attached to base 14 via a pivot bolt 80, such that its end 22*a* is allowed to pivot downwardly, as shown in FIG. 9A, and upwardly, as shown in FIG. 9B. Stops 82 and 84 of housing 70 act to limit the upward and downward travel of foot pedal 22. Switch mechanism 20 includes a pair of microswitches 72 and 74. Microswitch 72 includes a contact 72*a* and control terminals 76 and microswitch 74 includes a contact 74*a* and control terminals 78. Control terminals 76 and 78 are electrically coupled to a power supply and to the motor 16, in order to control the direction of rotation of the motor 16. Microswitches 72 and 74 are of conventional design and therefore the internal operation of the switches will not be described. Generally, when the foot pedal 22 is raised, causing end 22*a* to pivot downwardly, end 22*a* depresses contact 72*a*, as shown in FIG. 9A. As a result of this, microswitch 72 instructs motor 16 to rotate drive shaft 30 in a first direction, shown by arrow 90 in FIG. 7. As will be described further below, this causes impeller 54 to transfer water into fresh water transfer pipe 28 to fill bowl 12. Conversely, when foot pedal 22 is depressed, causing end 22*a* to pivot upwardly, end 22*a* depresses contact 74*a*, as shown in FIG. 9B. As a result of this, microswitch 74 instructs motor 16 to rotate drive shaft 30 in a second direction, opposite that shown by arrow 90 in FIG. 7. This causes impeller 60 to rotate, thereby evacuating the output chamber 48 through waste water outlet pipe 24.

Figure 9:
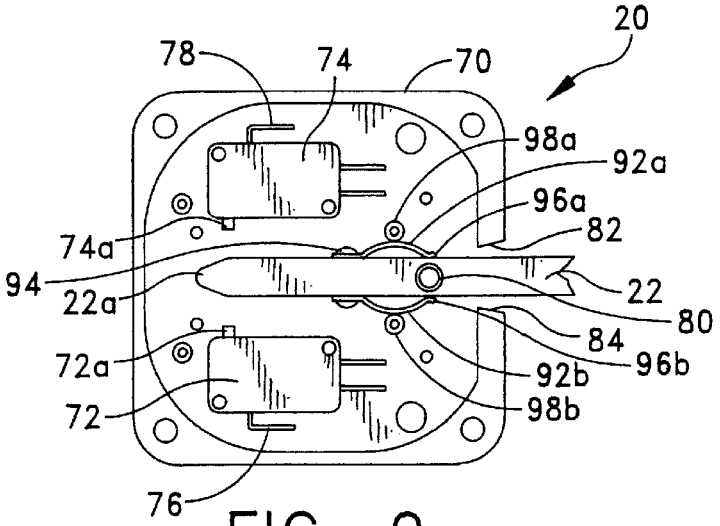
Figure 9B:
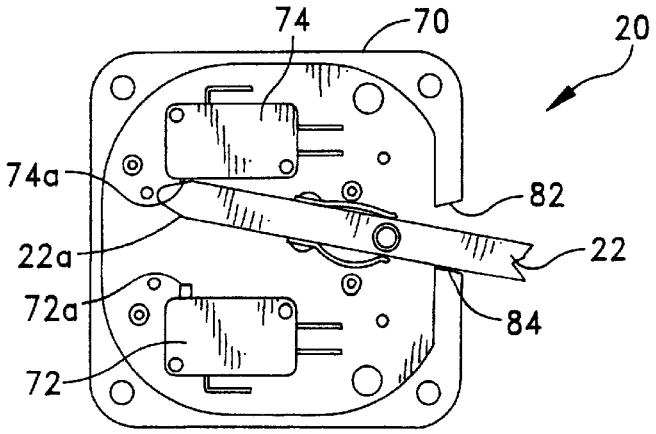

Foot pedal 22 is biased in the neutral position shown in FIG. 9 by a pair of leaf springs 92*a* and 92*b*. Leaf springs 92*a* and 92*b* are attached to foot pedal 22 at one end of each spring by a bolt 94, contact foot pedal 22 at the other end of each spring 96*a* and 96*b*, respectively, and are biased against posts 98*a* and 98*b*, respectively. Accordingly, when end 22*a* of foot pedal 22 pivots downwardly, as shown in FIG. 9A, spring 92*b* is compressed against post 98*b*. Similarly, when end 22*a* of foot pedal 22 pivots upwardly, as shown in FIG. 9B, spring 92*a* is compressed against post 98*a*. In either case, when foot pedal 22 is released, springs 92*a* and 92*b* return the foot pedal 22 to its neutral position, as shown in FIG. 9. A cover plate (not shown) is mounted on housing 70 to seal the switching mechanism and to protect the internal components.

The input chamber and output chamber may also include sacrificial anodes (not shown) in the form of replaceable zinc-coated bolts which are mounted within each of the input and output chambers. Since seawater is conductive, and different metals may be present in the toilet system, the zinc will corrode first, thus sparing the other metals in the system.

The operation of the toilet system will now be described. As described above, when not in use, the output chamber 48 and bowl 12 are empty. When a person desires to use the toilet system, the output chamber 48 and the bowl must be filled with fresh water. Therefore, the user would raise foot pedal 22, causing end 22*a* to pivot downwardly, thereby depressing contact 72*a* of microswitch 72. This causes microswitch 72 to send a signal to motor 16, instructing motor 16 to drive the drive shaft 30 in the direction of arrow 90, FIG. 7. When shaft 30 rotates in this direction, roller clutch bearing 56 engages shaft 30, causing rubber impeller 54 to rotate in the direction indicated by arrow 90. Due to the cam shape of the housing 18, as rubber impeller 54 rotates, a vacuum is created at the input port 50, which causes fresh water to be drawn into input chamber 46 through input port 50. Water is driven through input chamber 46 in the direction shown by arrow 100 and discharged through output port 52. The water flows out from output port 52, through fresh water transfer pipe 28 and into rim 12*a* of bowl 12. The water flows around rim 12*a* and into bowl 12 and output chamber 48 through a series of holes (not shown) located around the periphery of rim 12*a*. The user controls the amount of water which is transferred into the bowl 12 and output chamber 48 by releasing the foot pedal 22 when the desired amount of water is in the bowl 12 and output chamber 48.

Due to the orientation of roller clutch bearing 62 of impeller 60, when drive shaft 30 is rotated in the direction indicated by arrow 90, roller clutch bearing 62 is disengaged from drive shaft 30 and impeller 60 does not rotate.

When the user desires to evacuate the toilet system, the foot pedal 22 is depressed, causing end 22*a* to pivot upwardly, thereby depressing contact 74*a* of microswitch 74. This causes microswitch 74 to send a signal to motor 16, instructing motor 16 to drive the drive shaft 30 in the direction opposite that indicated by arrow 90, FIG. 7. When shaft 30 rotates in this direction, roller clutch bearing 62 engages drive shaft 30, causing impeller 60 to rotate in the direction indicated by arrow 102, FIG. 8. Since chopping mechanism 64 is fixed to drive shaft 30, it also rotates in this direction. Any solid material which is in the output chamber 48 is macerated within chopping portion 48*c* of output chamber 48. At the same time, impeller 60 pushes the waste water through base unit outlet port 36 and into waste water outlet pipe 24 for disposal of the waste water either in a holding tank or overboard of the vessel. Base unit outlet port 36 includes a valve (not shown) which allows waste to be discharged from the output chamber 48, but does not allow the waste to back-flow into the output chamber 48 from waste water outlet pipe 24.

Due to the orientation of roller clutch bearing 56 of impeller 54, when drive shaft 30 is rotated in the direction opposite that indicated by arrow 90, roller clutch bearing 54 is disengaged from drive shaft 30 and impeller 54 does not rotate.

Therefore, the present prevention provides a marine toilet system which is simple to use, occupies less deck space, operates efficiently, is less expensive to manufacture and is less prone to requiring maintenance.

While there is shown and described herein certain specific structure embodying the invention, it will be manifest to those skilled in the art that various modifications and rearrangements of the parts may be made without departing from the spirit and scope of the underlying inventive concept. For example, the base unit 14, bowl 12, input housing 18, impeller 60 and foot pedal 22 may be made from any suitable material which is capable of withstanding corrosion which can take place due to the presence of water, and especially salt water, on a marine vessel. Such materials include aluminum and plastics. Furthermore, while, in the preferred embodiment, leaf springs are used to bias foot pedal 20 in the neutral position, any type of spring may be used to perform this function. Also, while the invention has been described as being drawn to a marine vessel toilet system, the system may be used for any application, including recreational vehicles and portable toilets. Accordingly, the inventive concept is not limited to the particular forms herein shown and described.

What is claimed is:

1. A fluid circulation system comprising:

a bidirectional motor;

a first housing having a fluid inlet and a fluid outlet;

a second housing having a fluid inlet and a fluid outlet;

a fluid holding device coupled between said fluid outlet of said first housing and said fluid inlet of said second housing;

a drive shaft operatively coupled to said motor to be driven by said motor, said drive shaft extending from said motor into said first and second housings;

a first fluid transfer device mounted on said drive shaft within said first housing, said first fluid transfer device being operative to transfer fluid from said fluid inlet of said first housing, through said fluid outlet of said first housing and into said fluid holding device when said motor drives said drive shaft in a first direction; and a second fluid transfer device mounted on said drive shaft within said second housing, said second fluid transfer device being operative to transfer fluid from said fluid holding device, through said fluid inlet of said second housing and through said fluid outlet of said second housing when said motor drives said drive shaft in a second direction, said second direction being opposite said first direction.

2. The fluid circulation system of claim 1, wherein when said motor drives said drive shaft in said first direction, said first fluid transfer device is in an operative state and said second fluid transfer device is in an inoperative state.

3. The fluid circulation system of claim 2, wherein when said motor drives said drive shaft in said second direction, said second fluid transfer device is in an operative state and said first fluid transfer device is in an inoperative state.

4. The fluid circulation system of claim 1, further comprising a switch for controlling whether said motor drives said drive shaft in said first direction or said second direction.

5. The fluid circulation system of claim 4, including a first clutch mechanism constructed and arranged on said drive shaft to engage said first fluid transfer device to said drive shaft when said drive shaft is driven in said first direction and to disengage said first fluid transfer device from said drive shaft when said drive shaft is driven in said second direction.

6. The fluid circulation system of claim 5, including a second clutch mechanism constructed and arranged on said drive shaft to engage said second fluid transfer device to said drive shaft when said drive shaft is driven in said second direction and to disengage said second fluid transfer device from said drive shaft when said drive shaft is driven in said first direction.

7. The fluid circulation system of claim 6, wherein said first fluid transfer device further comprises a first impeller for driving said fluid from said fluid inlet of said first housing to said fluid outlet of said first housing and said second fluid transfer device further comprises a second impeller for driving said fluid from said fluid inlet of said second housing to said fluid outlet of said second housing, said first and second impellers being mounted to said first and second clutch mechanisms, respectively.

8. The fluid circulation system of claim 7, further comprising a chopping device mounted on said drive shaft between said fluid inlet of said second housing and said second fluid transfer device, said chopping device for breaking down solid matter which enters said second housing from said fluid holding device.

9. The fluid circulation system of claim 8, said fluid circulation device comprising a toilet system, said fluid holding device comprises a toilet bowl, said first fluid transfer device transfers water from a water source to said toilet bowl, said second fluid transfer device transfers water and waste from said toilet bowl to said fluid outlet of said second housing.

10. The fluid circulation system of claim 9, wherein said switch comprises a lever which, when raised, causes said motor to drive said drive shaft in said first direction, thereby causing said first fluid transfer device to transfer water from said water source to said toilet bowl, and when depressed, causes said motor to drive said drive shaft in said second direction, thereby causing said second fluid transfer device to transfer water and waste from said toilet bowl to said fluid outlet of said second housing.

11. The fluid circulation system of claim 7, said first and second clutch mechanisms comprising first and second roller clutches, respectively, wherein said first impeller is supported on said first roller clutch, and said second impeller is supported on said second roller clutch, said first and second roller clutches being mounted on said drive shaft so as to permit rotation of said first and second impellers in opposite directions.

12. A toilet system comprising:

a bidirectional motor for driving a drive shaft in first and second directions;

a housing having a first fluid inlet, a first fluid outlet and a first interior cavity disposed between said first inlet and said first outlet;

a first impeller for transferring fluid from said first fluid inlet to said first fluid outlet, said first impeller being supported on said drive shaft within said first interior cavity, wherein, when said motor drives said drive shaft in said first direction, said first impeller engages said drive shaft, rotates in said first direction and transfers fluid from said first fluid inlet to said first fluid outlet, and when said motor drives said drive shaft in said second direction, said first impeller disengages from said drive shaft, and thereby is idle;

a base unit having a second fluid inlet, a second fluid outlet and a second interior cavity disposed between said second fluid inlet and said second fluid outlet;

a second impeller for transferring fluid from said second fluid inlet to said second fluid outlet, said second impeller being supported on said drive shaft within said second interior cavity, wherein, when said motor drives said drive shaft in said second direction, said second impeller engages said drive shaft, rotates in said second direction and transfers fluid from said second fluid inlet to said second fluid outlet, and when said motor drives said drive shaft in said first direction, said second impeller disengages from said drive shaft, and thereby is idle;

a toilet bowl having a third fluid inlet and a third fluid outlet, said third fluid inlet being in fluid communication with said first fluid outlet of said housing and said third fluid outlet being in fluid communication with said second fluid inlet; and a switch for determining which of said first and second directions said bidirectional motor drives said drive shaft.

13. The toilet system of claim 12, wherein, when said motor drives said drive shaft in said first direction, said first impeller transfers fluid from said first inlet through said first outlet and into said toilet bowl, and when said motor drives said drive shaft in said second direction, said second impeller transfers fluid and waste from said toilet bowl, through said second inlet and through said second outlet.

14. The toilet system of claim 13, further comprising a chopping device supported on said drive shaft within said second interior cavity between said second inlet and said second impeller, wherein said chopping device chops any solid matter present in said toilet bowl as it is transferred from said toilet bowl to said second outlet.

15. The toilet system of claim 14, said second interior cavity having a ribbed interior surface proximate said chopping device for facilitating the chopping of said solid matter.

16. The toilet system of claim 13, wherein said first impeller comprises a number of vanes extending radially outward from a hub, said hub comprising a first roller clutch constructed and arranged on said drive shaft such that when said drive shaft is driven in said first direction, said first roller clutch engages said drive shaft, causing said first impeller to rotate in said first direction, and when said drive shaft is driven in said second direction, said first roller clutch disengages from said drive shaft.

17. The toilet system of claim 16, wherein said second impeller comprises a number of vanes extending radially outward from a hub, said hub comprising a second roller clutch constructed and arranged on said drive shaft such that when said drive shaft is driven in said second direction, said second roller clutch engages said drive shaft, causing said second impeller to rotate in said second direction, and when said drive shaft is driven in said first direction, said second roller clutch disengages from said drive shaft.

* * * * *